US008226137B2

(12) United States Patent
Kasper et al.

(10) Patent No.: US 8,226,137 B2
(45) Date of Patent: Jul. 24, 2012

(54) DUAL CHAIN HOIST ARRANGEMENT

(75) Inventors: Jürgen Kasper, Braunsbach (DE); Peter Kittsteiner, Waldenburg (DE)

(73) Assignee: Konecranes Plc, Hyvinkää (FI)

( * ) Notice: Subject to any disclaimer, the term of this patent is extended or adjusted under 35 U.S.C. 154(b) by 424 days.

(21) Appl. No.: 12/690,627

(22) Filed: Jan. 20, 2010

(65) Prior Publication Data

US 2010/0181788 A1 Jul. 22, 2010

(30) Foreign Application Priority Data

Jan. 21, 2009 (DE) ..... 10 2009 005 592

(51) Int. Cl.
*B66C 1/00* (2006.01)

(52) U.S. Cl. ..... 294/81.56; 294/81.21; 254/358

(58) Field of Classification Search ..... 294/81.56, 294/81.21, 67.1, 82.15, 74; 254/358, 372
See application file for complete search history.

(56) References Cited

U.S. PATENT DOCUMENTS

| | | | | |
|---|---|---|---|---|
| 3,805,967 | A * | 4/1974 | Scannell | 212/323 |
| 4,316,696 | A * | 2/1982 | Hoyerman | 414/542 |
| 4,909,555 | A * | 3/1990 | Blasi | 452/189 |
| 5,893,471 | A * | 4/1999 | Zakula | 212/345 |

* cited by examiner

*Primary Examiner* — Saul Rodriguez
*Assistant Examiner* — Gabriela Puig
(74) *Attorney, Agent, or Firm* — Leydig, Voit & Mayer, Ltd.

(57) ABSTRACT

A dual chain hoist having a lifting beam that can be telescopically extended and contracted, wherein load chains respectively extend to hook blocks suspended beneath the lifting beam in the vicinity of the ends of two telescoping sections that form the lifting beam. The distance between the telescoping sections can be varied with another chain. The chain for varying the length of the lifting beam extends over a chain wheel that is connected without rotational play to another chain wheel from which the load chain of the hook block of the respective telescoping lifting beam section.

15 Claims, 5 Drawing Sheets

DUAL CHAIN HOIST ARRANGEMENT

CROSS-REFERENCE TO RELATED APPLICATIONS

This patent application claims the benefit of German Patent Application No. 10 2009 005 592.4, filed Jan. 21, 2009.

FIELD OF THE INVENTION

The present invention relates generally to chain hoists, and more particularly, to a dual chain hoist having a lifting beam for supporting loads.

BACKGROUND OF THE INVENTION

Projecting loads or loads that tend to buckle cannot be hoisted with a single hook and belts. Such loads require the attachment of a lifting beam, from which the belts or other load suspension means are suspended in order to attach the load. This method is widely used, but has the disadvantage that the lifting beam must be replaced with another lifting beam when the dimensions of the load change.

Alternatively, it is also known to utilize chain hoists in the form of so-called dual chain hoists, in which two chain hoists are suspended from a lifting beam. These two chain hoists are usually actuated by a single drive motor for reasons of synchronization. The disadvantage of such chain hoists is the fixed spacing between the hooks that may be excessively small or excessively large. In order to adapt these hoists to the size of the load, it is once again required to use lifting beams at the height of the hooks or traction cables in order to increase or decrease the spacing between the hooks in accordance with the dimensions of the load.

Another disadvantage of such dual chain hoists results from the residual length, i.e., the smallest distance that the hooks can be from a building or wall when the dual chain hoist is moved in the direction of the wall. The remaining length increases considerably if the hooks are pulled toward one another with corresponding means.

OBJECTS AND SUMMARY OF THE INVENTION

It is an object of the present invention to provide a dual chain hoist in which the spacing is variable while the remaining length is maintained constant.

The novel dual chain hoist is equipped with an adjustable-length lifting beam. The lifting beam comprises first and second lifting beam sections that can be moved telescopically relative to one another. Each lifting beam section or lifting beam telescoping section has a distal or far end, as well as a proximal end or the end that faces the other lifting beam section.

A first chain wheel group consisting of two coaxial chain wheels that are inter-connected without rotational play is provided adjacent to the distal end of the first lifting beam section. Furthermore, the first lifting beam section is provided with a load chain anchor adjacent to the first chain wheel group, as well as an adjusting chain anchor. A first hook block is also associated with the first lifting beam section. The second lifting beam section is equipped with a second chain wheel group that is arranged axially parallel to the first chain wheel group. This second chain wheel group also comprises two coaxially arranged chain wheels that are interconnected without rotational play. This second chain wheel group is located on the distal or far end of the second lifting beam section. The second lifting beam section additionally comprises two adjacent deflection chain wheels that are axially parallel and are assigned to one of the load chains on which the second hook block is suspended. Another deflection chain wheel for an adjusting chain is located on the proximal or inner end of the second lifting beam section.

A separate load chain is assigned to each of the two hook blocks. The first load chain extends from the first chain wheel group to the first hook block and from there to the load chain anchor on the first lifting beam section. The other load chain extends from the first chain wheel group to the axially parallel chain wheels in the second lifting beam section, then to the hook block and ultimately from the hook block to the second chain wheel group on the distal end of the second lifting beam section via the other chain wheel of this deflection group.

An adjusting chain extends around the still available chain wheel of the second chain wheel group, as well as the deflection chain wheel on the proximal end of the second lifting beam section. Both of its free ends are anchored to the adjusting chain anchor of the first lifting beam section.

Since the two lifting beam sections can be telescopically adjusted, the hook blocks can be moved toward or away from one another depending on the given application. Consequently, it is possible to adjust any hook spacing within the possible adjusting range. This adjustment is effected by setting the second chain wheel group in rotation. This causes the two lifting beam sections to move relative to one another. The second load chain simultaneously is effectively shortened in accordance with the telescoping movement. Consequently, the second chain wheel group forms as it were, a virtual anchor for the second load chain that takes up or pays out the chain in accordance with the adjustment in order to maintain the second hook block at the same height as prior to the adjustment regardless of the adjustment of this second hook block. Both hook blocks usually remain at the same height. In certain applications, however, it may also be reasonable to adjust the heights relative to one another, wherein this height adjustment is not influenced by the adjustment of the lifting beam width.

A closer inspection of the forces shows that the force in the second load chain is exactly as high as that in the adjusting chain. However, both chain forces have opposite signs such that in the end the second chain wheel group is practically torque-free toward the outside. Consequently, the adjustment of the lifting beam length can be effected with a drive that generates a considerably lower torque than the drive for the first chain wheel group.

The chain wheels of the first chain wheel group and the chain wheels of the second chain wheel group may have the same number of chain pockets. It is expedient if the chain wheels within a chain wheel group have the same number of chain pockets such that the chain or the corresponding length of the chain that moves over the respective chain wheel group travels with the same speed. In order to prevent the slack lengths of the load chains from becoming entangled, it is practical to provide two chain storage pockets adjacent to the first chain wheel group.

Each lifting beam section may be provided with a propelling mechanism in the vicinity of its distal end such that the dual chain hoist can be displaced along a running rail. The running rail may consist of the bridge of a bridge crane. At least one of the propelling mechanisms may be provided with a motor. If applicable, it is practical to actually provide only one propelling mechanism motor such that the adjustment of the lifting beam length is not impaired by the respective propelling mechanism motor.

In order to secure the adjustment, a brake mechanism is preferably assigned to the second chain wheel group. If a conventional drive also used for lifting gears in chain hoists is used to drive the second chain wheel group, the brake mechanism is already structurally integrated into the drive system.

Other objects and advantages of the invention will become apparent upon reading the following detailed description and upon reference to the drawings, in which:

Figure 1:
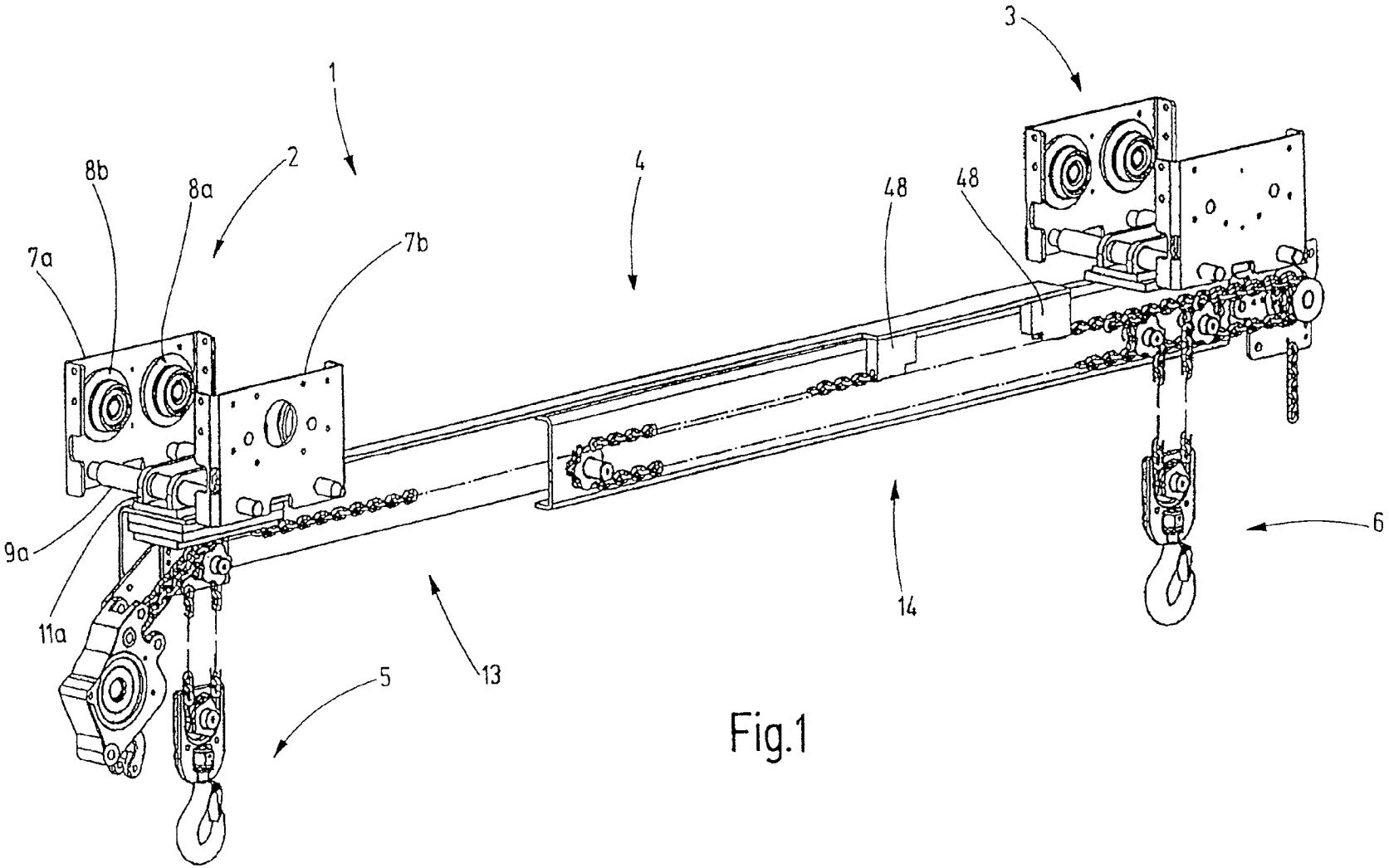
FIG. 1 shows a simplified partially sectioned perspective view of a dual chain hoist in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention. The following description of the figures clarifies features for understanding the invention, whereby a person skilled in the art can deduce from the figures details that are not described but that supplement the description of the figures. It should be clear that numerous modifications and combinations are possible.

The drawings also are not necessarily true-to-scale. Certain regions may be illustrated in exaggerated size in order to emphasize details, whereby the drawings are furthermore greatly simplified and do not contain everything that may be provided for practical implementation. The terms "top" and "bottom" or "front" and "rear," as well as "left" and "right," respectively refer to the normal position of use and the pertinent hoisting gear terminology.

DESCRIPTION OF THE PREFERRED EMBODIMENTS

Referring now more particularly to the drawings, there is shown an illustrative dual chain hoist 1 in accordance with the invention, which basically comprises two propelling mechanisms 2,3, a length adjustable lifting beam 4, and two hook blocks 5,6 mounted in depending fashion from opposite ends of the adjustable lifting beam 4. The illustrated propelling mechanisms 2 includes two trolley side cheeks 7*a*,7*b* that are aligned parallel to one another. The trolley side cheek 7*a* carries two rotatably supported flanged wheels 8*a*,8*b*, and corresponding flanged wheels are provided on the opposite inner side of the trolley side cheek 7*b* in the form of a mirror image relative to the flanged wheels 8*a* and 8*b*.

Through-bolts 12 are used for screwing the two trolley side cheeks 7*a*,7*b* to corresponding brackets 11*a*,11*b* with spacer elements 9*a*,9*b* therebetween. On each propelling mechanism, the two side cheeks 7*a*,7*b* are mounted on the respective lifting beam 13,14 with two sets of spacer elements 9*a*,9*b* and a bolt 12. The design of the propelling mechanism 3 corresponds to the design of the propelling mechanism 2 such that further description is unnecessary. It will be understood by a person skilled in the art that one of the two propelling mechanisms 2,3 is provided with a drive motor in order to drive one or both flanged wheels 8*a*,8*b* and thereby move the dual chain hoist 1 along a crane bridge.

Figure 2:
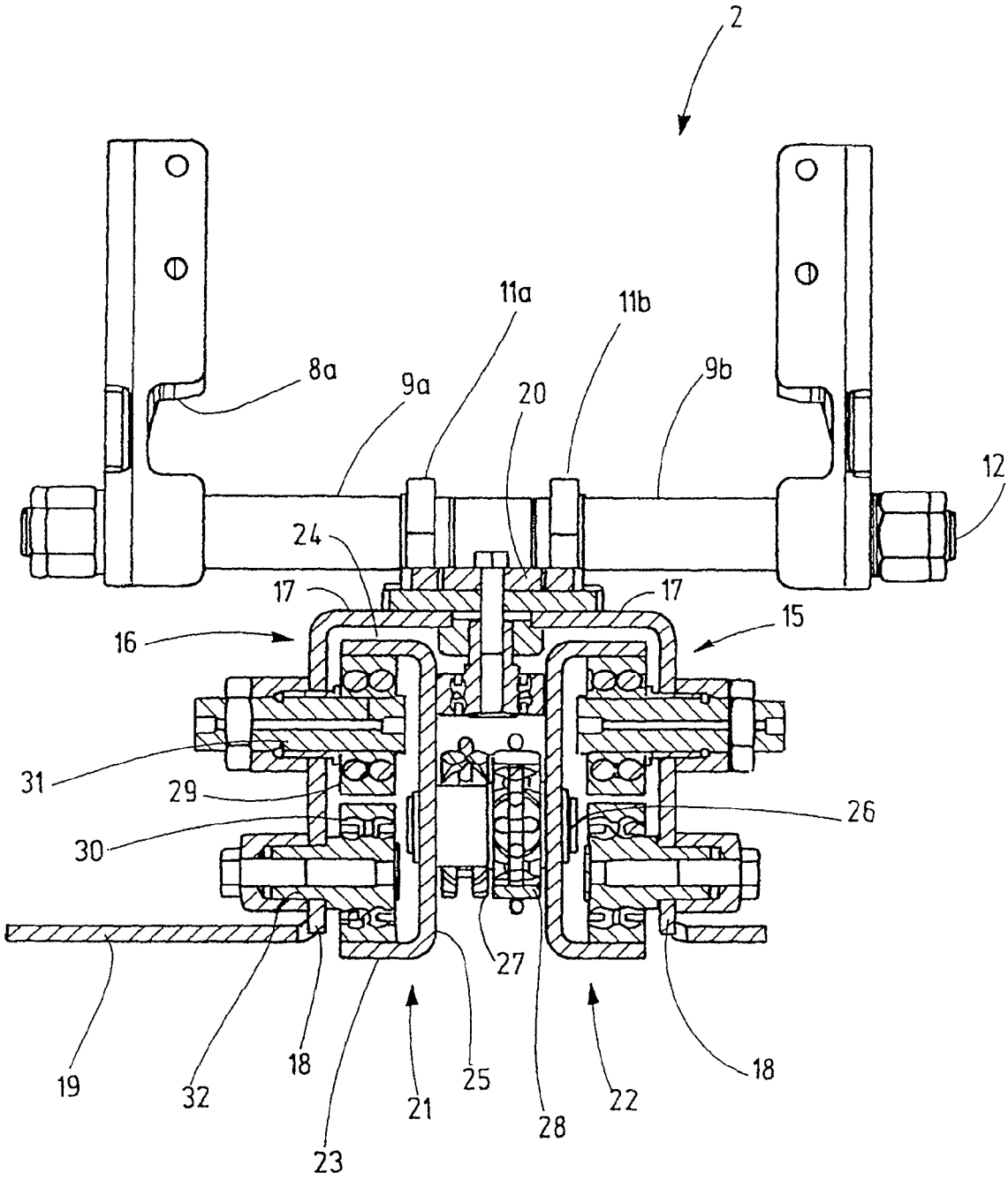
FIG. 2 is an enlarged vertical section of the lifting beam arrangement of the dual chain hoist shown in FIG. 1.

The lifting beam 4 includes of two lifting beam sections 13,14 that can be telescopically adjusted relative to one another in the longitudinal direction. As depicted in FIG. 2, the lifting beam section 13 includes two Z-shaped, profiled rail sections 15, 16 that respectively consist of a short leg or flange 17, a central section 18 and an outwardly directed leg or flange 19. The Z-profiled rail sections 15, 16 are arranged in such a way that they form an upside-down U. They are connected to one another by means of corresponding mounting plates 20 in the region of the propelling mechanism 2, i.e., in the region of the short legs 17 that face one another and extend horizontally. The two Z-profiled rail sections 15,16 are arranged parallel to one another with a constant spacing and with the lower flanges 17,19 lying in a common horizontal plane. Consequently, the two Z-profiled rail sections 15,16 are connected at one end by means of the plate 20 of the propelling mechanism 2.

The lifting beam section 14 is formed by two parallel U-profiled rail sections 21, 22 that are spaced apart from one another and arranged as shown in FIG. 2. Each U-profiled rail section 21,22 consists of two parallel short legs 23,24 and a back section 25. The back sections 25 face one another.

In the region of the propelling mechanism 3, the U-profiled rail sections 21,22 are similarly connected to the Z-profiled rail sections 15,16. A person skilled in the art is familiar with this type of connection such that it does not have to be described in greater detail at this point.

On the end remote from the propelling mechanism 3, which represents the proximal end referred to the two U-profiled rail sections 21,22 are connected to one another by means of an axle 26 on which two chain wheels 27,28 are arranged to rotate freely. In addition, a rigid connecting piece may also be inserted adjacent to the chain wheels 27,28.

The movable connection between the lifting beam section 13 and the lifting beam section 14 is facilitated by groups of deep-groove ball bearings 29,30 that are seated on rigid axles 31,32. The rigid axles 31,32 are connected to the central section 18 of the Z-profiled rail section 16 as shown and extend perpendicular thereto. The two deep-groove ball bearings 29,30 are arranged one on top of other on the inner side of the leg 18 and separated by a certain distance, such that they adjoin the inner side of the short legs 23,24 of the U-profiled rail section 21. Deep groove ball bearings that cooperate with the U-profiled rail section 22 similarly are arranged one on top of the other on the right side in the form of a mirror image relative to the deep-groove ball bearings 29,30 on the left side, as viewed in FIG. 2.

Preferably, at least one other set of a total of four bearing arrangements of the described type is provided along the lifting beam 4 in alignment with the described bearing arrangement on the opposite side between the Z-profiled rail section 15 and the U-profiled rail section 22, as well as at least two more groups of this type at a distance therefrom in the direction of the propelling mechanism 3, such that the lifting beam section 13 can be moved longitudinally relative to the lifting beam section 14 over the entire adjusting path with the aid of at least eight ball bearings. The lifting beam section 14 can be moved longitudinally in the groove-like cavity between the two Z-profiled rail sections 15,16 with the aid of the described bearing arrangement. This accordingly increases and decreases the distance between the propelling mechanisms 2,3, as well as the distance between the hooks or hook blocks 5,6 as described further below.

Figure 3:
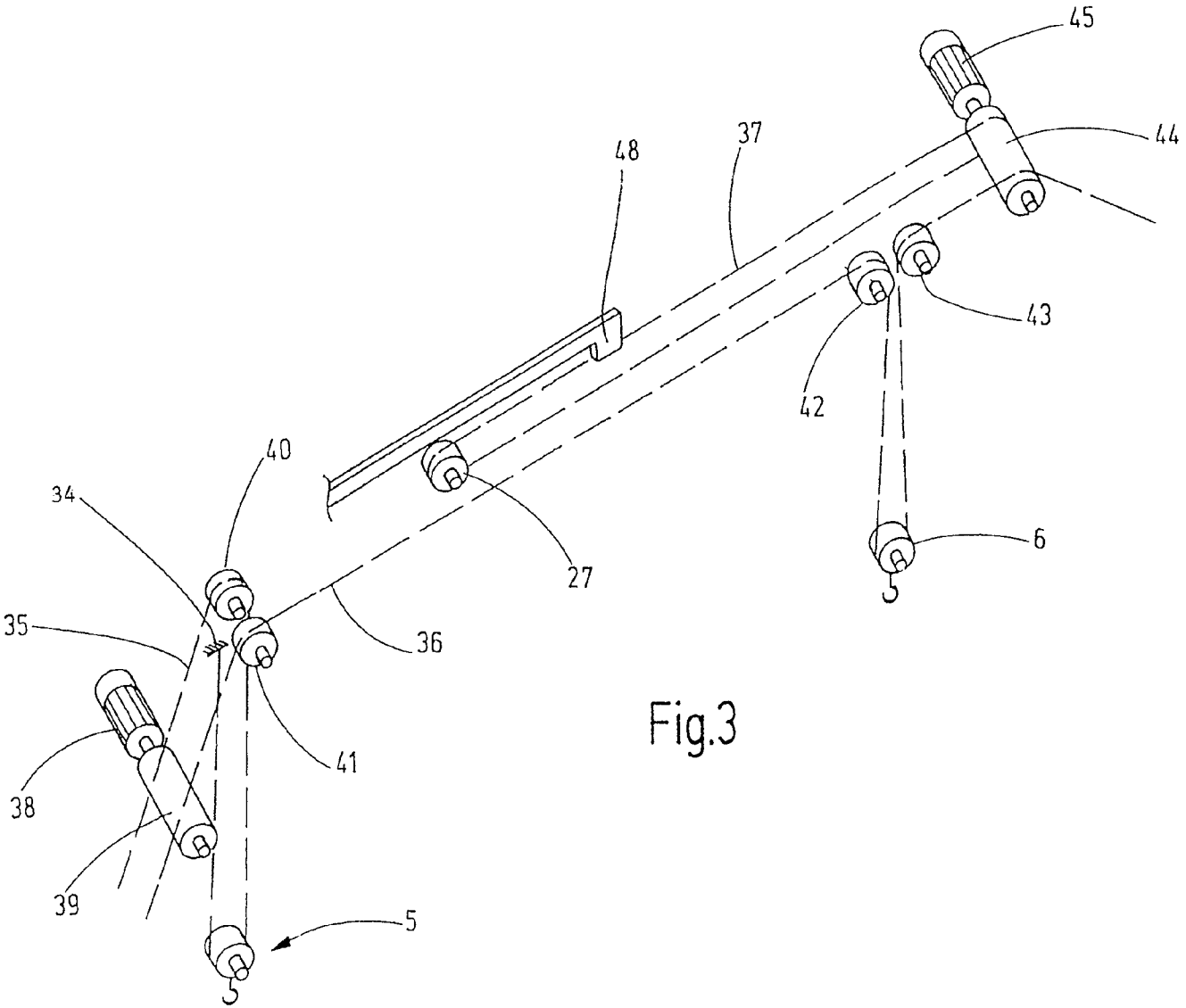
FIG. 3 is a schematic of the individual chains and their supporting chain and deflection wheels of the illustrated dual chain hoist.

FIG. 3 schematically shows how the chains extend within the dual chain hoist 1, wherein this figure only shows the chain wheels, but not support elements for holding the chain wheels. The dual chain hoist 1 in this case includes two load chains 35, 36, as well as an adjusting chain 37. The chains 35,36,37 all may be round link chains and have the same geometry. The two load chains 35,36 are driven by means of a drive motor 38, wherein the two chain wheels that form a chain wheel group 39 are seated on the gear output shaft of said drive motor. As schematically depicted in FIG. 3, the chain wheels included in the chain wheel group 39 are arranged and connected coaxially to one another without rotational play. They have the same number of pockets. This chain wheel group 39 is located slightly below the lifting beam 4 for spatial considerations.

Two loose deflection chain wheels 40,41 are rotatably supported by the lifting beam section 13, i.e., within the lifting beam section 13 and below the propelling mechanism 2. The two chain wheels 40,41 are arranged coaxially but can turn independently of one another. The load chain 35 driven by the chain wheel group 39 extends from the corresponding chain wheel of the chain wheel group 39 to the deflection sprocket 40 and from there vertically downward to the hook block 5. From this hook block 5, the load chain 35 once again extends upward to the lifting beam section 13. Its free end is anchored at a chain anchor 34 on the underside of the lifting beam section 13.

The load chain 36 extends from the other chain wheel of the chain wheel group 39 over the deflection chain wheel 41 and then into the space between the two U-profiled rail sections 21,22 in the lifting beam section 14. Two deflection chain wheels 42,43 are rotatably supported in axially parallel relation to each other and at a distance from one another in the lifting beam section 14 beneath the propelling mechanism 3. From the deflection chain wheel 41, the load chain 36 extends over the deflection chain wheel 42.

From the deflection chain wheel 42, the load chain 36 extends through the hook block 6 and then once again upward in the direction of the lifting beam section 14. Within the lifting beam section 14, the load chain 36 extends from the hook block 6 over the deflection chain wheel 43 and then to another chain wheel group 44 on the other end of the lifting beam 4. The chain wheel group 44 includes two coaxially arranged chain wheels that are interconnected without rotational play. The chain wheels of the chain wheel group 44 have the same number of chain pockets. They preferably also have the same number of chain pockets as the chain wheel group 39, but, this is not essential. The chain wheel group 44 is located adjacent to the propelling mechanism 3. The slack length of the load chain 36 formed after the chain wheel group 44 extends into a chain pocket arranged beneath the propelling mechanism 3.

The load chain 36 also lies on the loosely rotatable chain wheel 28 in order to minimize the sag of the load chain 36 within the lifting beam 4. While the chain wheel 28 is not illustrated in FIG. 3 in order to provide a better overview, it is located on the distal end of the lifting beam section 14 between the chain wheel group 39 and the deflection chain wheel 42.

The chain wheel group 44 is seated on the output shaft of a geared motor 45 that is provided with an internal brake mechanism, as is common practice for chain hoists. Consequently, the brake mechanism need not be described in detail at this point.

As soon as the chain wheel group 44 is stopped, it acts as a chain anchor for the load chain 36. The two load chains 35,36 are synchronously moved over the same adjusting path by setting the chain wheel group 39 in motion with the aid of the geared motor 38. Since the free ends of the two load chains are respectively fixed on the anchor 34 and on the chain wheel group 44, the two hook blocks 5,6 move the same distance in the same direction. Both hook blocks 5, 6 can generate the same force.

One end of the adjusting chain 37 is fixed on an anchor 48 that is arranged on the distal end of the lifting beam section 13 and protrudes between the two U-profiled rails 21,22 of the lifting beam section 14. From this anchor 48, the load chain 37 extends to the freely rotating deflection chain wheel 27 that is supported between the two U-profiled rails 21,22 on the distal end of the lifting beam section 14 as shown in FIG. 2. After a 180° deflection around the chain wheel 27, the adjusting chain 37 extends over the corresponding chain wheel of the chain wheel group 44 and then back to the anchor 48.

Regardless of the function of the load chain 36, an adjustment of the chain wheel group 44 in the clockwise direction, as depicted in FIG. 3, causes the anchor 48 to be pulled toward the chain wheel group 44. Thus, the two lifting beam sections 13,14 are moved toward each other. A rotation of the chain wheel group 44 in the counterclockwise direction, in contrast, pulls the anchor 48 in the direction of the deflection chain wheel 27 so that the distance between the hook blocks 5,6 is increased.

In understanding the operation, it is now assumed that the dual chain hoist 1 is in the position shown schematically in FIG. 3. If the chain wheel group 44 is moved in the counterclockwise direction in this position, the anchor 48 is pulled towards the propelling mechanism 3 as described above, i.e., the hook block 5 that is located beneath the propelling mechanism 2 and connected to the lifting beam section 13 by means of the anchor 34 and the deflection chain wheel 40 moves in the direction of the hook block 6. The section of the load chain 36 between the deflection chain wheel 41 and the deflection chain wheel 42 would become excessively long due to this movement. However, since the chain wheel group 44 carries a second chain wheel for the load chain 36, the dual chain wheel 44 moves the excessive section of the load chain 36 through the lifting beam and over the dual chain wheel 44 to the extent that the two sections 13, 14 approach one another. During the adjustment, the load chain 36 runs, as it were, through the hook block 6 with the result that the hook block 6 ultimately remains at the height shown regardless of the distance adjusted between the hook blocks 5, 6. This also applies analogously to the movement in the other direction, i.e., additional load chain 36 is required between the chain wheel group 39 and the outgoing chain wheel 42 when the lifting beam sections 13, 14 are moved away from one another. This additional load chain is transported into the lifting beam 4 from a corresponding storage located beneath the chain wheel group 44 with the aid of the chain wheel group 44 when the motor 45 is set in motion. In other words, the upper length of the adjusting chain 37 in FIG. 3 carries out the same travel in the same moving direction as that carried out by the load chain 36 between the deflection chain wheel 43 and the chain wheel group 44.

As apparent from the foregoing function, it is only required that the chain wheel group 44 have two chain wheels: one for the adjusting chain 37 and one for the load chain 36. This operational requirement can be fulfilled if the two chain wheels have the same number of chain pockets. While the chain wheel group 44 does not have to correspond to the chain wheel group 39 with respect to the chain pockets per chain wheel, it is advantageous if both chain wheel groups are identical.

In other respects, an examination of the forces reveals that the drive motor 45 can have a considerably lower rating than the drive motor 38. A load suspended on the hook block 6 has the tendency to pull the chain section of the load chain 36 between the deflection chain wheel and the chain wheel group 44 toward the left with respect to FIG. 3. This generates a torque in the counterclockwise direction on the chain wheel group 44. This force simultaneously has a tendency to move the two lifting beam sections 13, 14 toward one another. Due to the introduced torque, however, the force acts in the opposite direction in the adjusting chain 38, i.e., a torque of the chain wheel group 44 in the counterclockwise direction subjects the lower length of the adjusting chain 38 to tensile stress such that the adjusting chain 38 has the tendency to pull the anchor 48 away from the chain wheel group 44. In other words, the longitudinal forces cancel each other out in the region of the chain wheel group 44, and it suffices to drive this chain wheel group by means of a drive that need merely be able to generate the adjusting forces and has a slight deceleration effect in order to prevent an undesirable adjustment due to asymmetries resulting from friction.

Figure 4:
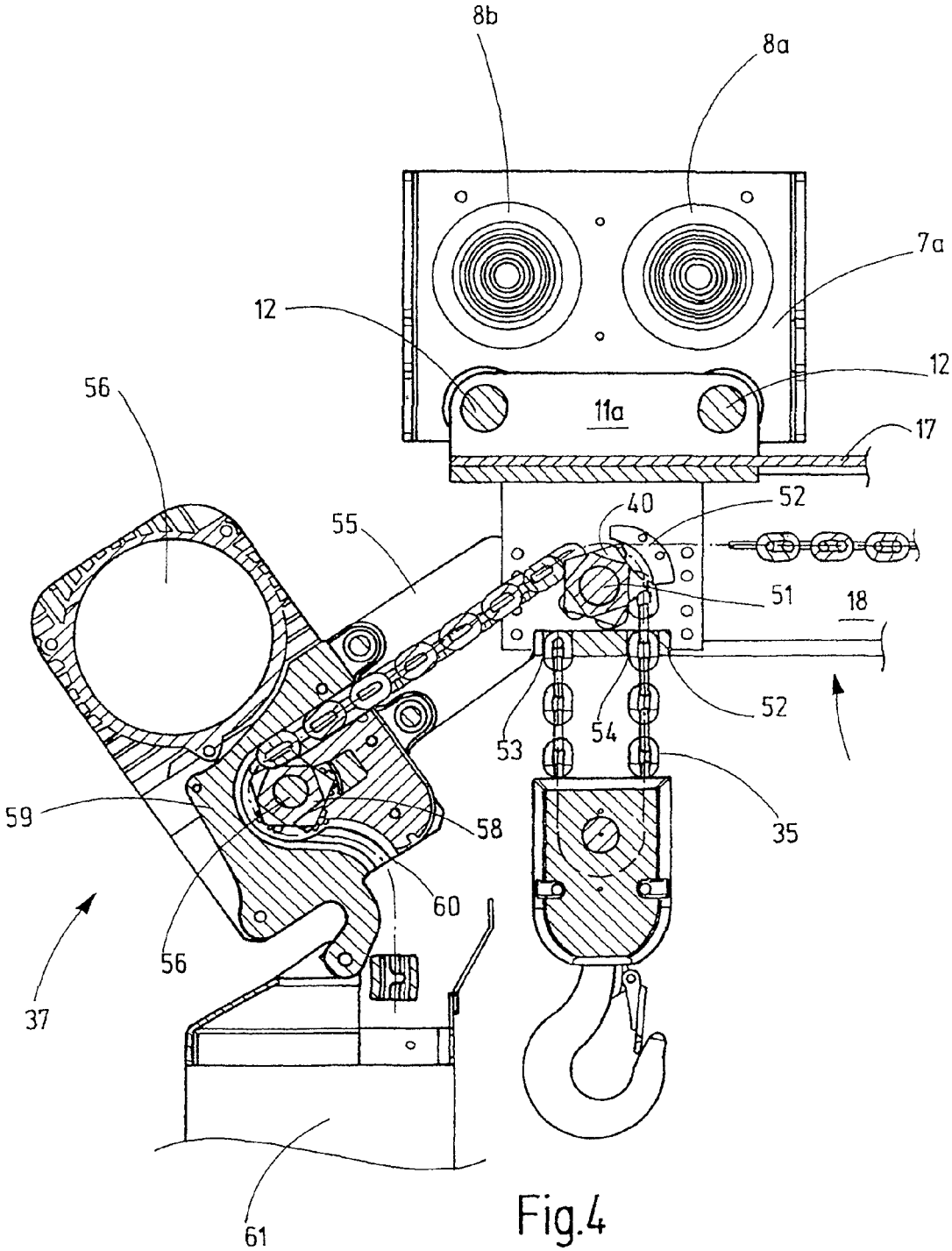
FIG. 4 is an enlarged fragmentary section of a left end of the dual chain hoist shown in FIG. 1.

Further details regarding the structured design of the drives are provided below with reference to FIG. 4, which shows the left end of the dual chain hoist 1. The illustration is sectioned parallel to the lifting beam 4 along the vertical center plane. In this instance, the chain wheel 40 is seated on an axle 51 held between the Z-profiled rails 15,16. The outer chain wheel 41 is not visible due to the sectioned illustration. The chain wheel 40 is partially surrounded by a chain guide element 52 that is mounted on the leg 18 of the Z-profiled rail 15.

A chain guide plate 52 with openings 53,54 that are aligned with the lengths of the load chain 35 is located beneath the chain wheel 40. An arm 55 extends toward the left side and is angled obliquely downward, wherein the drive 38 is mounted on this arm. The drive 38 comprises a drive motor 56 that drives a gear output shaft 57 via a gear. The two chain wheels belonging to the chain wheel group 39 are seated axially parallel on the gear output shaft. Due to the sectioned illustration, however, only the rear chain wheel 58, around which the load chain 35 extends, is visible in this figure.

The chain wheel group 39 is surrounded by a chain wheel housing 59 that contains corresponding chain guide channels 60 for the two load chains 35,36. As depicted, the chain guide channel 60 of the load chain 35 extends obliquely downward. A chain storage pocket 61 is located beneath the outlet of the chain guide channel 60. As will be understood, another chain storage pocket that corresponds to the chain storage pocket 61, as well as the chain wheel of the chain wheel group 39 that is assigned to the load chain 36, is disposed above the plane of projection.

The other end of the chain guide channel 60 is arranged in such a way that the chain extends from the chain wheel 57 to the deflection chain wheel 40 without a sharp bend. The free end of the load chain 35 is anchored in the opening 53 in the plate 52. This opening simultaneously forms the anchor 34.

Figure 5:
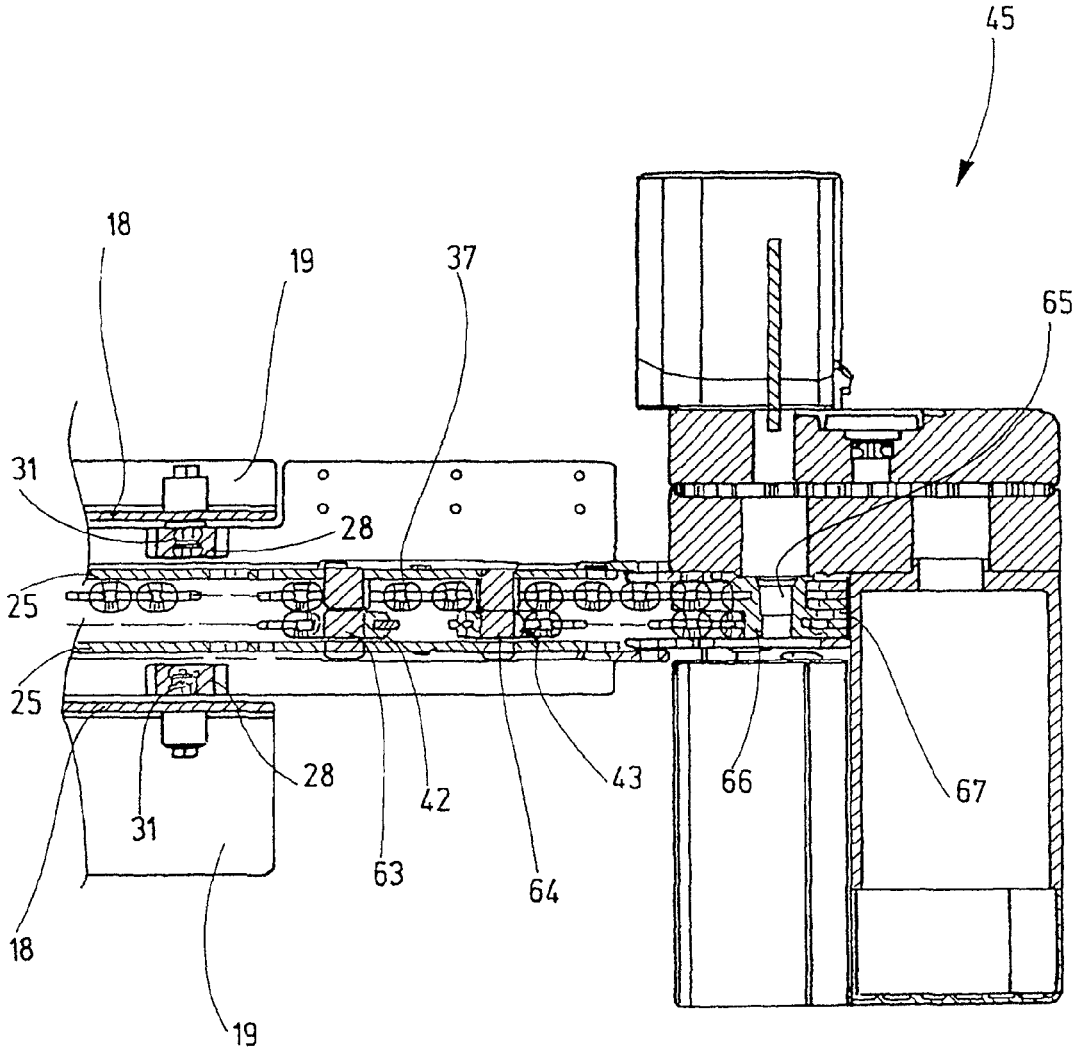
FIG. 5 is a top view of the right end of the dual chain hoist shown in FIG. 1.

FIG. 5 shows a top view of the right end of a dual chain hoist 1, wherein this illustration is sectioned approximately at the height of the axis of the guide roller bearings 29. According to this figure, the two deflection chain wheels 42,43 are rotatably seated on two parallel axles 63,64. The load chain 36 extends downward into the gap between these chain wheels perpendicular to the plane of projection while the adjusting chain 37 extends laterally past the two chain wheels 42,43. The drive motor 45 is arranged on the right free end. Two chain wheels 66,67 that form the chain wheel group 44 are seated adjacent to one another on the gear output shaft 65 of this drive motor without rotational play.

From the foregoing, it can be seen that a dual chain hoist is provided that includes a lifting beam that can be telescopically extended and contracted, wherein load chains respectively extend to hook blocks suspended beneath the lifting beam in the vicinity of the ends of the two telescoping sections that form the lifting beam. The distance between the telescoping sections can be varied with another chain. The chain for varying the length of the lifting beam extends over a chain wheel that is connected without rotational play to another chain wheel that serves as an anchor for the load chain of the hook block of the given telescoping lifting beam section.

The invention claimed is:

1. A dual chain hoist arrangement comprising:

a length-adjustable lifting beam (4) including a first lifting beam section (13) and second lifting beam section (14), said lifting beam sections (13,14) being connected to one another such that they can be moved relative to one another in a longitudinal direction, said lifting beam sections (13, 14) each having one end that is located proximal to the other lifting beam section (13, 14) and a distal end away from the other lifting beam section (13, 14), a first chain wheel group (39) including two coaxially arranged chain wheels that are connected to one another without rotational play and are rotatably supported on the distal end of the first lifting beam section (13), a load chain anchor (34) adjacent to the first chain wheel group (39), an adjusting chain anchor (48) at the proximal end of the first lifting beam section (13), a first hook block (5) associated with the first lifting beam section (13), a second chain wheel group (44) including two coaxially arranged chain wheels that are connected to one another without rotational play, said chain wheels of said second chain wheel group (44) being rotatably supported at the distal end of the second lifting beam section (14) and arranged axially parallel to the first chain wheel group (39), two spaced-apart deflection chain wheels (42,43) supported axially parallel to the first chain wheel group (39) and arranged on the second lifting beam section (14), a deflection chain wheel (27) adjacent a proximal end of the second lifting beam section (14), a second hook block (6) associated with the second lifting beam section (14), a first load chain (35) that extends from the first chain wheel group (39) to the first hook block (5) and from the first hook block (5) to the load chain anchor (34), a second load chain (36) that extends from the first chain wheel group (39) to one of the two deflection chain wheels (42), and then to the second hook block (6), and ultimately from the second hook block (6) to the second chain wheel group (44) over the second deflection chain wheel (43), and an adjusting chain (37) that extends around a chain wheel of the second chain wheel group (44) and around the deflection chain wheel (27) on the proximal end of the second lifting beam section (14), and said adjusting chain (37) having ends that are fixed to said adjusting chain anchor (48).

2. The dual chain hoist arrangement of claim 1 in which the chain wheels of the first chain wheel group (39) have the same number of chain pockets.

3. The dual chain hoist arrangement of claim 1 in which the chain wheels of the second chain wheel group (44) have the same number of chain pockets.

4. The dual chain hoist arrangement of claim 1 including two chain receiving storage pockets (61) disposed adjacent to the first chain wheel group (39).

5. The dual chain hoist arrangement of claim 4 including a single chain receiving storage pocket disposed adjacent to the second chain wheel group (44).

6. The dual chain hoist arrangement of claim 1 in which said second chain wheel group (44) has a brake mechanism.

7. The dual chain hoist arrangement of claim 1 in which each chain wheel group (39, 44) has a respective separate drive motor (38,45).

8. The dual chain hoist arrangement of claim 7 in which the drive motor (45) of the second chain wheel group (44) has a lower drive torque rating than the drive motor (38) of the first chain wheel group.

9. The dual chain hoist arrangement of claim 1 in which each lifting beam section (13, 14) has a respective propelling mechanism (2, 3).

10. The dual chain hoist arrangement of claim 9 in which each propelling mechanism (2, 3) is located adjacent to the distal end of the respective lifting beam section (13, 14).

11. The dual chain hoist arrangement of claim 9 in which at least one of the propelling mechanisms (2,3) has a propelling mechanism motor.

12. The dual chain hoist arrangement of claim 1 in which said first chain wheel group (39) is arranged below the first lifting beam section (13), and including deflection chain wheels (40,41) disposed at the height of said first lifting beam section (13) about which said first and second load chains (35,36) are trained.

13. The dual chain hoist arrangement of claim 1 in which said first lifting beam section (13) includes two parallel Z-profiled rail sections that are arranged adjacent to one another and define a downwardly open groove.

14. The dual chain hoist arrangement of claim 1 in which the second lifting beam section (14) includes two parallel U-profiled sections that are arranged adjacent to one another and back-to-back (25), and said second load chain (36) and adjusting chain (37) extend between said profile sections.

15. The dual chain hoist arrangement of claim 1 in which said deflection chain wheels (42,43) are disposed in closer relation to said second chain wheel group (39) then to the proximal end of said second lifting beam section (14).

* * * * *